US005848029A

United States Patent [19]

Chang

[11] Patent Number: 5,848,029

[45] Date of Patent: Dec. 8, 1998

[54] MOTION LIQUID DISPLAY TOY

[76] Inventor: Yu-Shun Chang, No. 10, Lane 105, Pao Tsing Street, Taipei, Taiwan

[21] Appl. No.: 676,835

[22] Filed: Jul. 8, 1996

[51] Int. Cl.[6] ..... G04B 19/06

[52] U.S. Cl. ..... 368/229; 368/223; 368/45

[58] Field of Search ..... 368/229, 223, 368/45; 446/134, 135, 136

[56] References Cited

U.S. PATENT DOCUMENTS

| | | | |
|---|---|---|---|
| 5,050,876 | 9/1991 | Chuang | 446/134 |
| 5,159,583 | 10/1992 | Lee | 368/223 |
| 5,189,821 | 3/1993 | Lee | 40/406 |
| 5,301,444 | 4/1994 | Horiuchi | 40/426 |
| 5,462,472 | 10/1995 | Lin | 446/135 |
| 5,463,826 | 11/1995 | Horiuchi | 446/134 |

*Primary Examiner*—Bernard Roskoski

*Attorney, Agent, or Firm*—Bacon & Thomas

[57] ABSTRACT

A motion liquid display toy including a base, a transparent container mounted on the base and holding a liquid, a floating ornament floating in the liquid and having a magnet at the bottom, and a transmission mechanism mounted in the base and controlled to force the floating ornament to move in the liquid, wherein the transmission mechanism includes a dial horizontally disposed in the base below the transparent container and having a center hole, an output shaft protruding over the center hole of the dial, a link horizontally suspending above the dial, the link having a first end coupled to the output shaft and a second end terminating in a coupling device, and a magnetic member coupled to the coupling device of the link, the magnetic member of the transmission mechanism being turned round to act with the magnet of the floating ornament when the output shaft is turned to move the link over the dial, thereby causing the floating ornament to move forwards and backwards in the liquid, to sink or float in the liquid, and to turn round.

17 Claims, 11 Drawing Sheets

MOTION LIQUID DISPLAY TOY

BACKGROUND OF THE INVENTION

The present invention relates to a motion liquid display toy which uses a transmission mechanism to move a magnetic member relative to the magnet of a floating ornament, causing the floating ornament to move forwards or backwards or to sink or float in a liquid, or to turn round.

Various liquid display toys using a transmission mechanism to move a movable magnet relative to a fixed magnet in an ornament floating in a liquid, have been disclosed, and have appeared on the market. FIG. 1 shows a motion liquid display toy according to the prior art, which comprises a transparent container A, two liquids of different specific gravity B contained in the transparent container A, a floating ornament C put in the liquids B and having a magnet C1 at the bottom, a clock D connected to the transparent container A at the bottom. The second's hand D1 of the clock D is covered with a magnetic substance D2. Because the magnetic substance D2 is fixedly secured to the second's hand D1, the floating ornament C is pulled by the magnetic force of the of the magnetic substance D2 to make a rotary motion synchronous to the movement of the second's hand D1 upon the operation of the clock D. FIG. 2 shows another structure of motion liquid display toy according to the prior art, which comprises a hollow base E, a transparent container A mounted on the hollow base E, two liquids of different specific gravity B contained in the transparent container A, a floating ornament C put in the liquids B and having a magnet C1 at the bottom, a motor drive M mounted in the hollow base E, a sloping arm F coupled to and balanced on the output shaft of the motor drive M and having two magnetic members D2 at two opposite ends. When the motor drive M is started, the sloping arm F is rotated, thereby causing the magnetic members D2 to alternatively react with the magnet C1 of the floating ornament C, and therefore the floating ornament C is forced to float up and down in the liquids B. The aforesaid motion liquid display toys can only force the floating ornament to move in a fixed course regularly. Therefore, these toys are less attractive.

SUMMARY OF THE INVENTION

The present invention provides a motion liquid display toy which comprises a base, a transparent container mounted on the base and holding a liquid, a floating ornament floating in the liquid and having a magnet at the bottom, and a transmission mechanism mounted in the base and controlled to force the floating ornament to move in the liquid. The transmission mechanism comprises a dial horizontally disposed in the base below the transparent container and having a center hole, an output shaft protruding over the center hole of the dial, a link horizontally suspending above the dial, the link having a first end coupled to the output shaft and a second end terminating in a coupling device, and a magnetic member coupled to the coupling device of the link, the magnetic member of the transmission mechanism being turned round to act with the magnet of the floating ornament when the output shaft is turned to move the link over the dial, thereby causing the floating ornament to move forwards and backwards in the liquid, to sink or float in the liquid, and to turn round. According to an alternate form of the present invention, an annular locating ring is mounted in the base, having an inward annular flange adapted for supporting the movement of the magnetic member.

DETAILED DESCRIPTION OF THE PREFERRED EMBODIMENT

Figure 1:
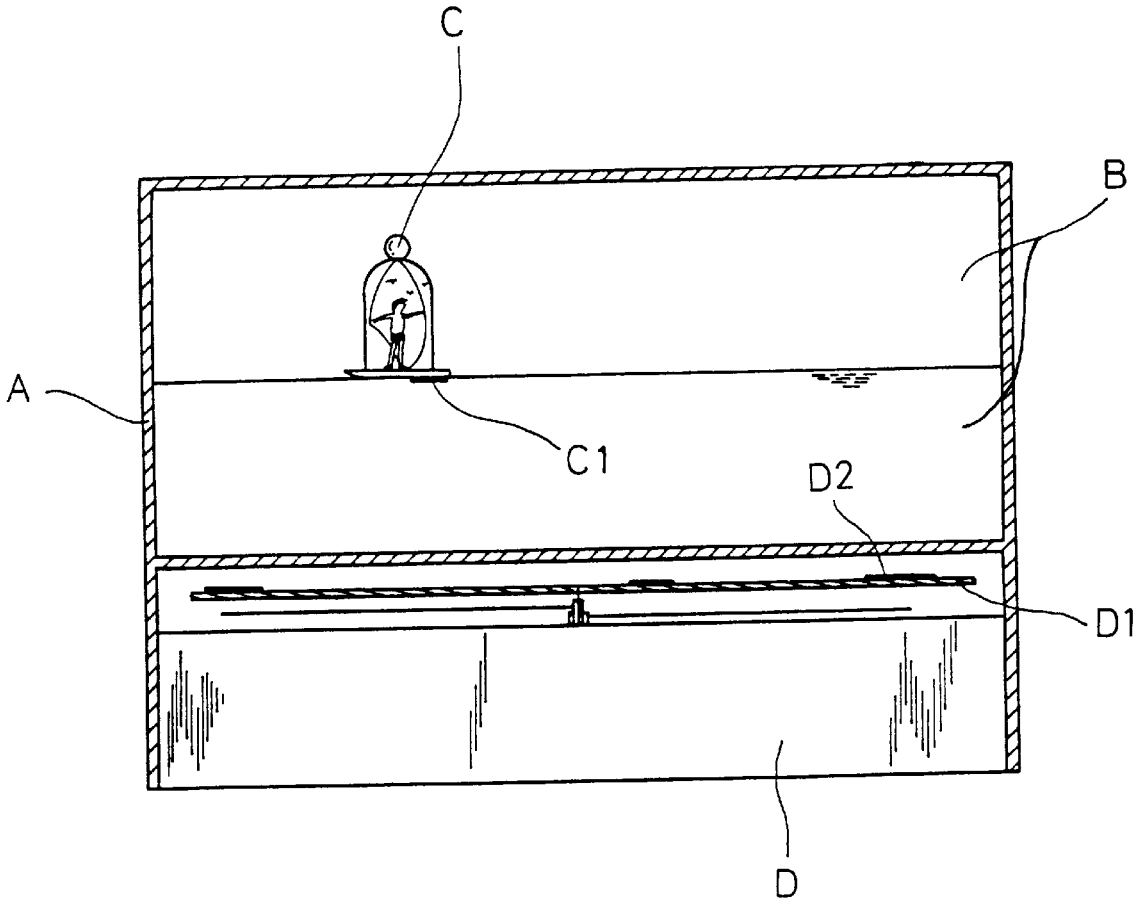
FIG. 1 is a sectional view of a liquid display toy according to the prior art.
Figure 2:
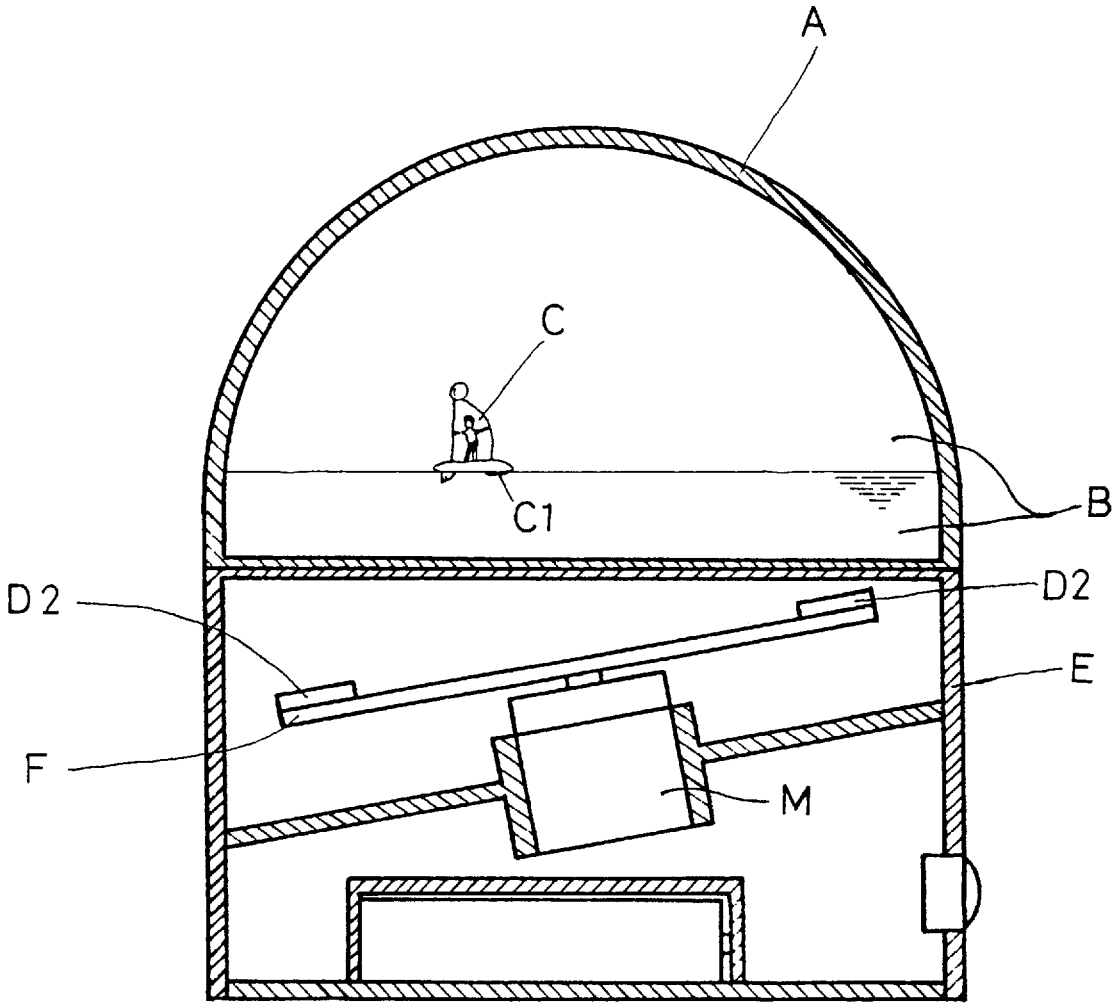
FIG. 2 is a sectional view of another structure of liquid display toy according to the prior art.
Figure 3:
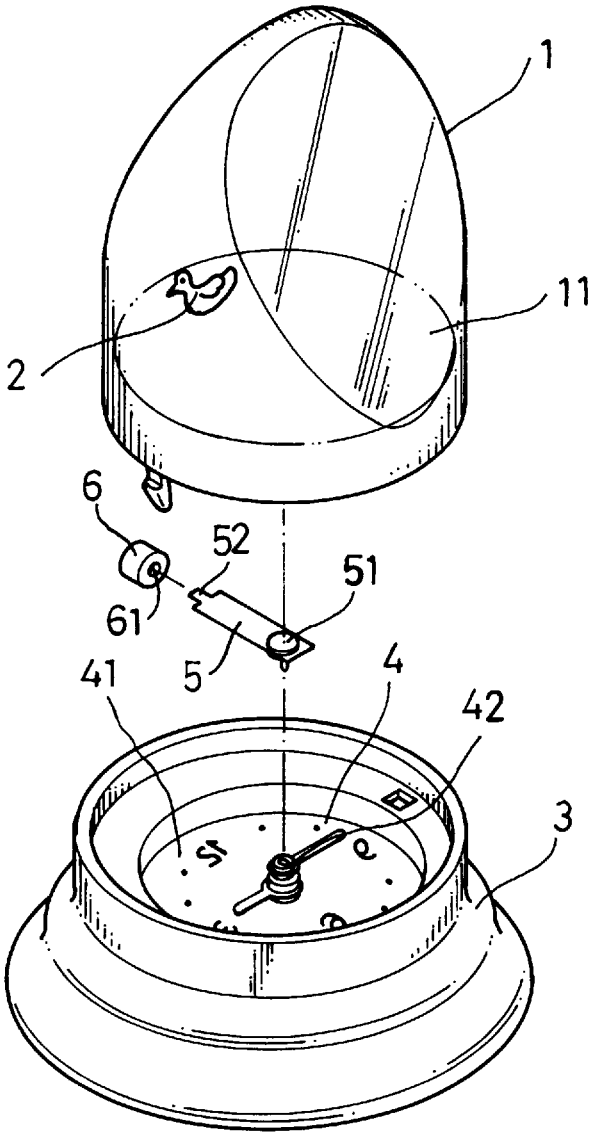
FIG. 3 is an exploded view of a motion liquid display toy according to e first embodiment of the present invention.
Figure 4:
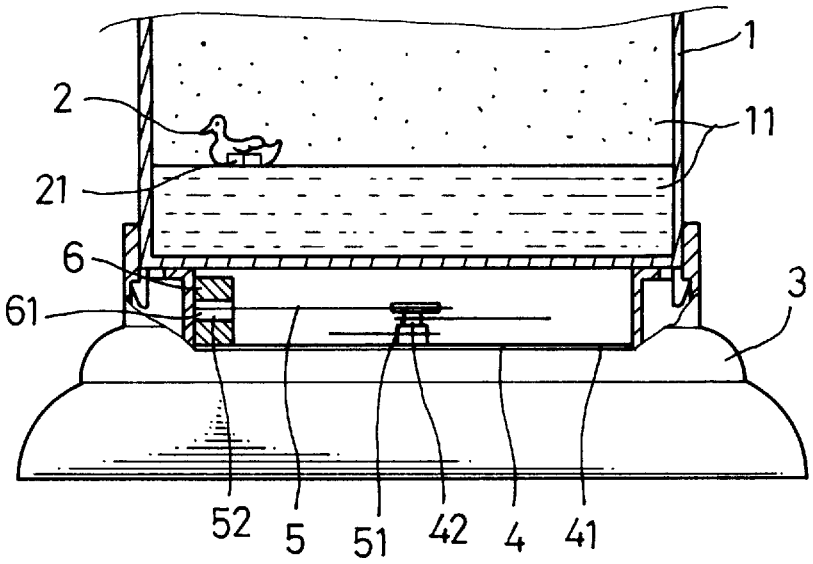
FIG. 4 is a sectional view of the motion liquid display toy of the first embodiment of the present invention.

Referring to FIGS. 3 and 4, a motion liquid display toy according to a first embodiment of the present invention is generally comprised of a transparent container 1, a floating ornament 2, a base 3, a transmission mechanism 4, a link 5, and a magnetic member 6. The transparent container 1 holds a liquid 11. The floating ornament 2 floats in the liquid 11 inside the transparent container 1, having a magnet 21 transversely disposed at the bottom. The base 3 is coupled to the bottom side of the transparent container 1. The transmission mechanism 4 is mounted in the base 3, having a dial 41 and an output shaft 42 extending out of the center of the dial 41. The transmission mechanism 4 can be the movement of a lock, the clockwork of a musical box, a motor drive, or any suitable motion work mechanism. The link 2 has a connector 51 at one end coupled to the output shaft 42 of the transmission mechanism 4, and a coupling rod 52 at an opposite end coupled to the magnetic member 6. The magnetic member 6 is a cylindrical magnet turned about the coupling rod 52 of the link 5, having an axial hole 61, which receives the coupling rod 52 of the link 5. The N and S poles of the cylindrical magnet 6 are disposed at the periphery.

Referring to FIG. 4 again, when the transmission mechanism 4 is started, the output shaft 42 is driven to turn the link 5 above the dial 41. Because the cylindrical magnet 6 is coupled to the coupling rod 52 of the link 5, the cylindrical magnet 6 is moved with the link 5 over the dial 41 through a rotary motion when the link 5 is turned by the output shaft 42 of the transmission mechanism 4. When the N pole of the cylindrical magnet 6 faces the S pole of the magnet 21 of the floating ornament 2, a magnetic attractive force is induced to attract the floating ornament 2, thereby causing the floating ornament 2 to be moved forwards (or downwards) in the liquid 11. When the cylindrical magnet 6 is turned about the coupling rod 52 of the link 5 in the counter-clockwise direction and the S pole of the cylindrical magnet 6 is forced toward the S pole of the magnet 21 of the floating ornament 2, a magnetic repulsive force is produced to push the floating ornament 2 backwards (or upwards). Furthermore, the deflecting magnetic force between the two opposite poles of the annular magnet 6 can force the floating ornament 2 to turn on its own axis. Therefore, when the cylindrical magnet 6 is turned about the coupling rod 52 of the link 5, the polarization and strength of magnetic force are relatively changed, thereby causing the floating ornament 2 to move forwards or backwards in the surface of the liquid 11, to sink or float in the liquid 11, or to turn round.

Figure 5:
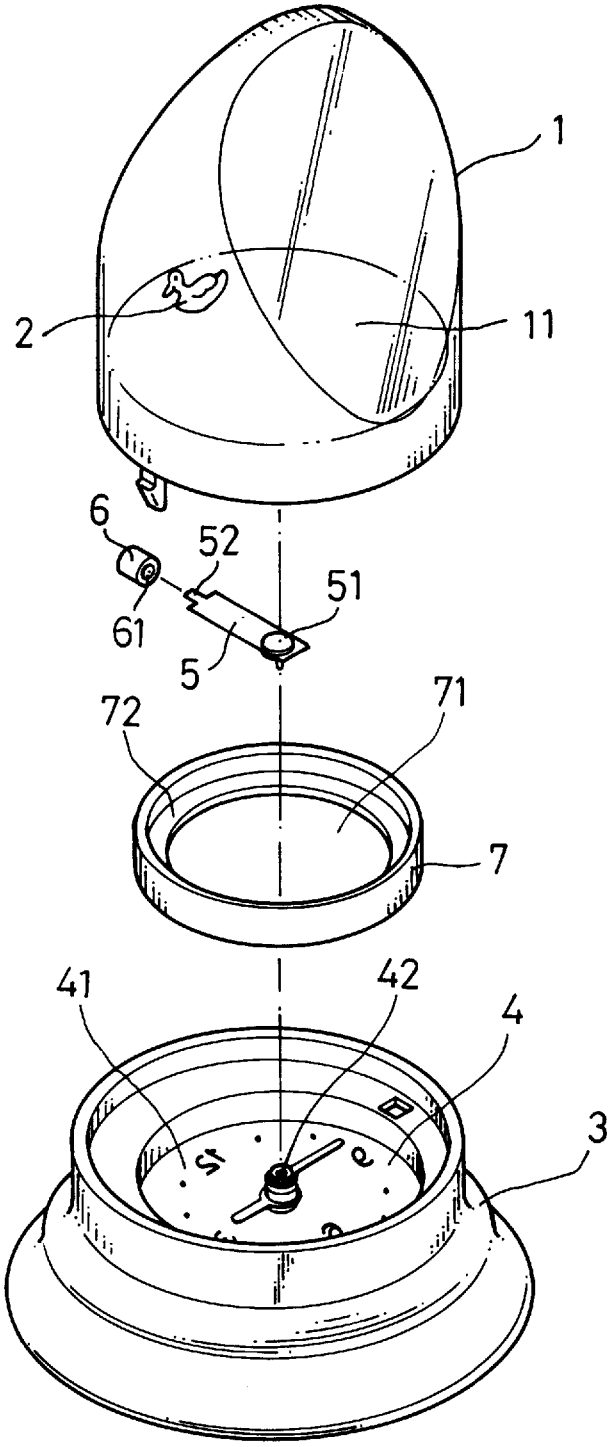
FIG. 5 is an exploded view of a motion liquid display toy according to the second embodiment of the present invention.
Figure 6:
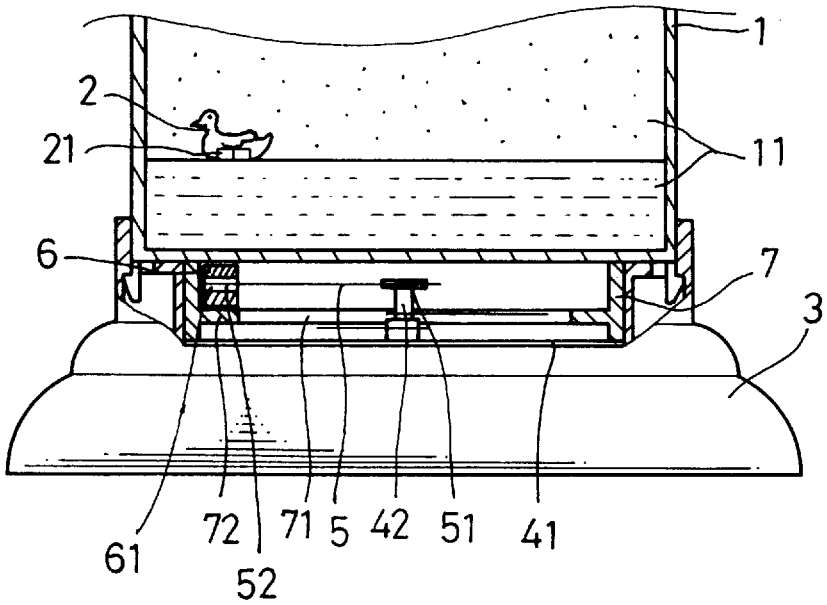
FIG. 6 is a sectional view of the motion liquid display toy of the second embodiment of the present invention.

FIGS. 5 and 6 show a motion liquid display toy according to a second embodiment of the present invention. This alternate form is similar to the aforesaid first embodiment of the present invention with the exception of a locating ring. As illustrated, a locating ring 7 is mounted within the base 3 and stopped above the dial 41. The locating ring 7 has a center hole 71, and an inward annular flange 72 around the center hole 71 and adapted for supporting the cylindrical magnet 6. Therefore, the inward annular flange 72 serves as an annular track for supporting the movement of the annular magnet 6. When the transmission mechanism 4 is started to move the link 5, the cylindrical magnet 6 is moved by the link 5 along the inside annular flange 72 and forced to turn about the coupling rod 52 of the link 5, and therefore the floating ornament 2 is caused to move forwards or backwards in the surface of the liquid 11, to sink or float in the liquid 11, or to turn round.

Figure 7A:
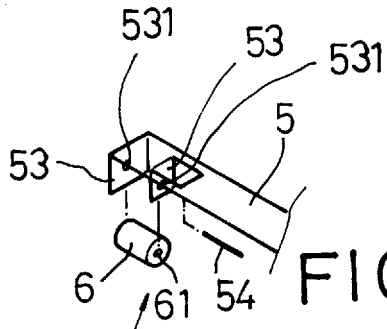
FIG. 7A is an exploded view of a part of FIG. 7, showing the relationship between the link and the cylindrical magnet.
Figure 7:
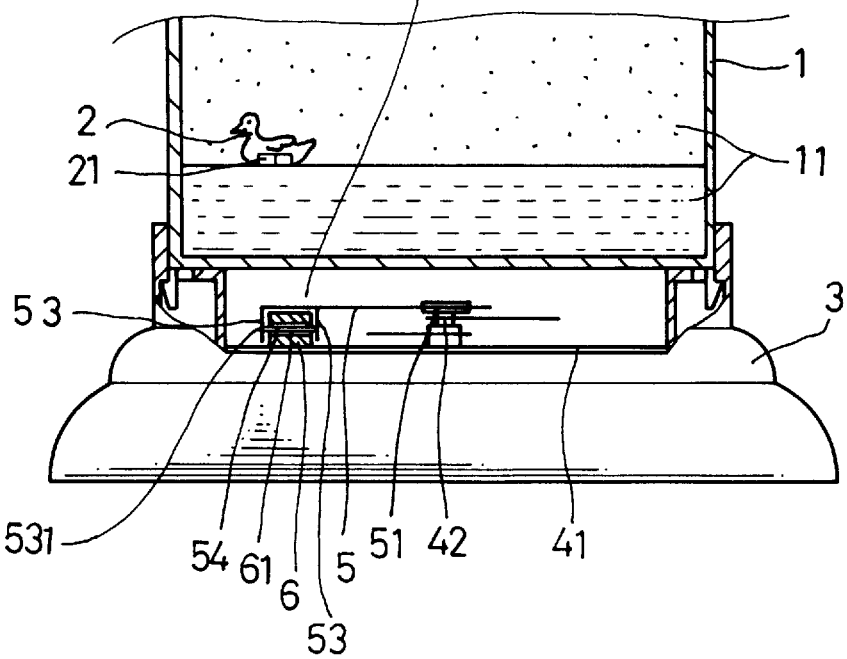
FIG. 7 is a sectional view of a motion liquid display toy according to the third embodiment of the present invention.

FIG. 7 and 7A show a motion liquid display toy according to a third embodiment of the present invention. This alternate form is also comprised of a base 3, a transparent container 1 mounted on the base 3 and holding a liquid 11, a floating ornament 2 floating in the liquid 11 and having a magnet 21 at the bottom, a transmission mechanism 4 mounted in the base 3 below the transparent container 1, the transmission mechanism 4 having a dial 41 and an output shaft 42 extending out of the center of the dial 41, a link 5 having a connector 51 at one end coupled to the output shaft 42 of the transmission mechanism 4, and a cylindrical magnet 6 revolvably coupled to the link 5 remote from the connector 51 to react with the magnet 21 of the floating ornament 2. According to this alternate form, the link 5 has two parallel projecting strips 53 raised from the bottom side at one end remote from the connector 51. The projecting strips 53 have a respective pivot hole 531. A pivot pin 54 is inserted through the axial hole 61 of the cylindrical magnet 6, having two opposite ends respectively fastened to the pivot holes 531 of the projecting strips 53. Therefore, the cylindrical magnet 6 can be turned about the pivot pin 54. When the transmission mechanism 4 is started to move the link 5, the cylindrical magnet 6 is moved by the link 5 along the inside annular flange 72 and forced to turn about the pivot pin 54, and therefore the floating ornament 2 is caused to move forwards or backwards in the surface of the liquid 11, to sink or float in the liquid 11, or to turn round.

Figures 8, 8A:
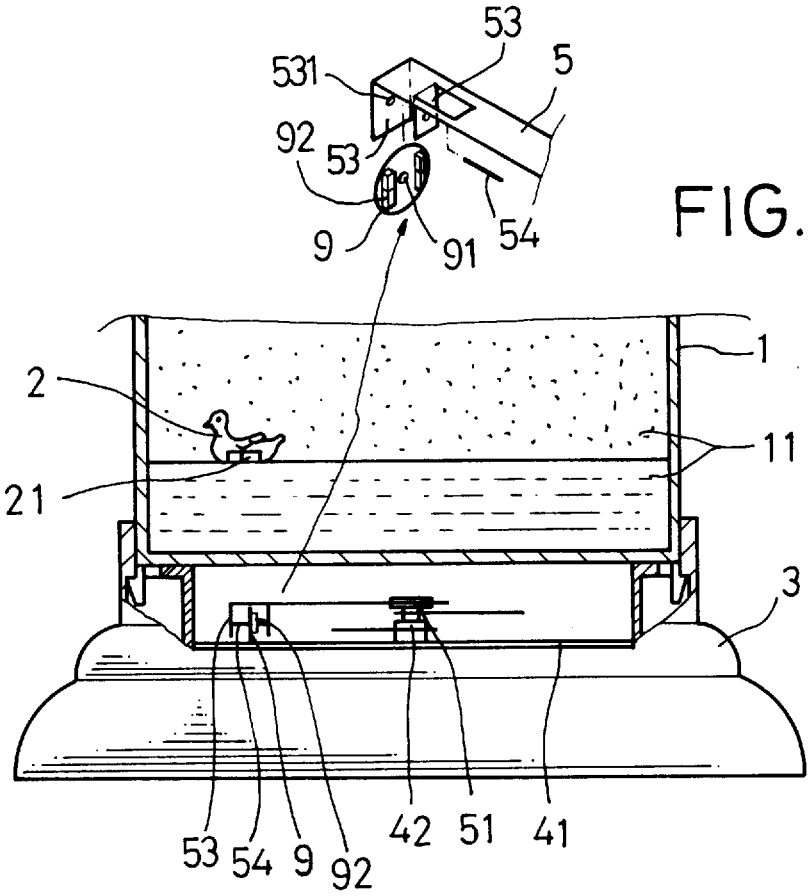
FIG. 8 is a sectional view of a motion liquid display toy according to the fourth embodiment of the present invention.
FIG. 8A is an exploded view of a part of FIG. 8, showing the relationship between the link and the disk member.
Figure 13:
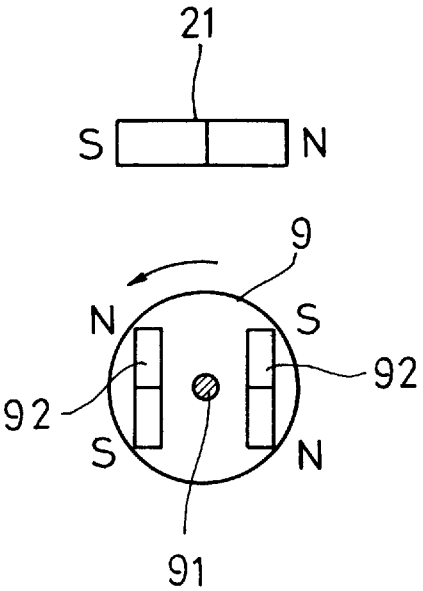
FIG. 13 is a schematic drawing showing the movement of the disk with magnetic bars relative to the magnet of the floating ornament according to the present invention.

FIGS. 8 and 8A show a motion liquid display toy according to a fourth embodiment of the present invention. This alternate form is similar to the third embodiment shown in FIGS. 7 and 7A, however a disk member 9 is used and turned about the pivot pin 54 instead of the aforesaid cylindrical magnet 6. The disk member 9 has a center hole 91 through which the pivot pin 54 passes, and two magnetic bars 92 reversely disposed at two opposite sides. When the link 5 is turned by the output shaft 42 of the transmission mechanism 4, the disk member 9 is forced to turn about the pivot pin 54, thereby causing the magnetic bars 92 to alternatively attract or repulse the magnet 21 of the floating ornament 2 (see also FIG. 13). Therefore, the floating ornament 2 is forced to move forwards or backwards in the surface of the liquid 11, to sink or float in the liquid 11, or to turn round.

Figures 9, 9A:
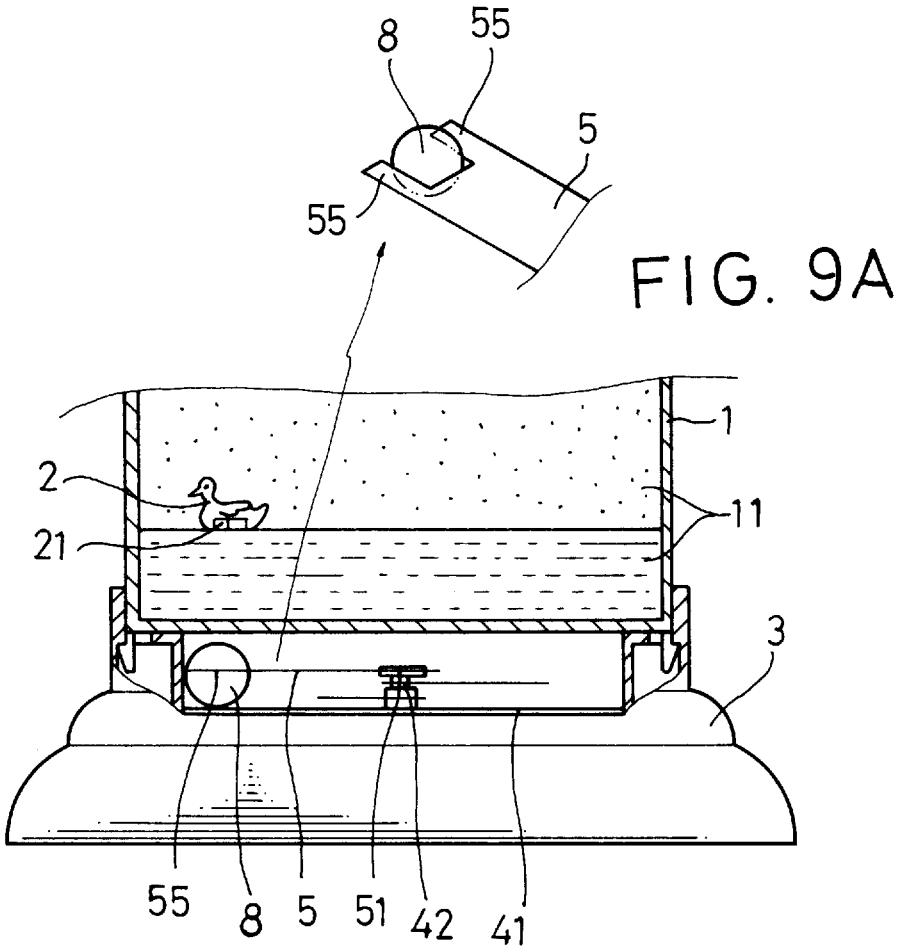
FIG. 9 is a sectional view of a motion liquid display toy according to the fifth embodiment of the present invention.
FIG. 9A is an enlarged view of a part of FIG. 9, showing the spherical magnet supported on the link between the two projecting rods.
Figure 12:
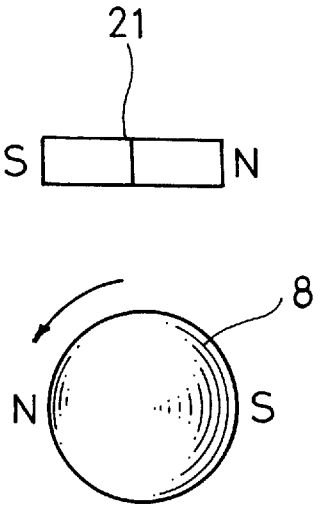
FIG. 12 is a schematic drawing showing the movement of the spherical magnet relative to the magnet of the floating ornament according to the present invention.

FIGS. 9 and 9A show a motion liquid display toy according to a fifth embodiment of the present invention. According to this alternate form, the link 5 has two parallel projecting rods 55 longitudinally disposed at one end remote from the connector 51 adapted for holding a spherical magnet 8. When the link 5 is turned by the output shaft 42 of the transmission mechanism 4, the spherical magnet 8 is turned round and round and moved over the dial 41 and acts with the magnet 21 of the floating ornament 2 (see also FIG. 12), thereby causing the floating ornament 2 to move forwards or backwards in the surface of the liquid 11, to sink or float in the liquid 11, or to turn round. Furthermore, the height of the projecting rods 55 is preferably not shorter than the radius of the spherical magnet 8, so that the spherical magnet 8 can be maintained in between the projecting rods 55 when moved over the dial 41.

Figures 10, 10A:
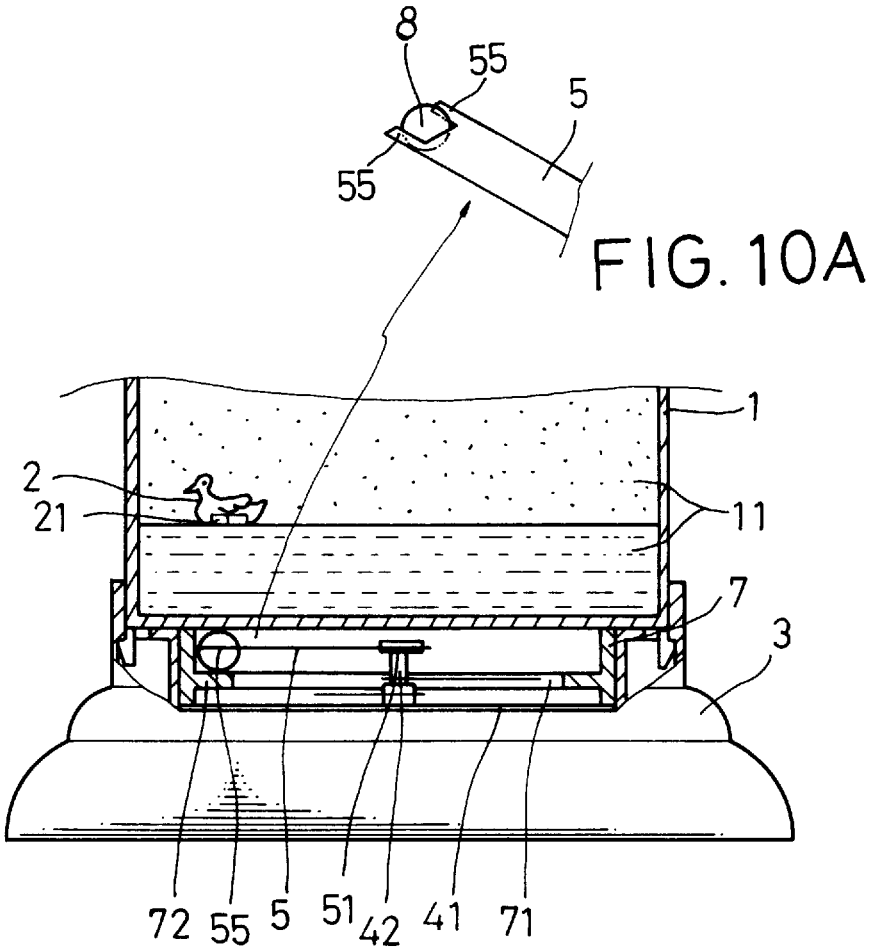
FIG. 10 is a sectional view of a motion liquid display toy according to the sixth embodiment of the present invention.
FIG. 10A is an enlarged view of a part of FIG. 10, showing the spherical magnet supported on the link between the two projecting rods.
Figure 11:
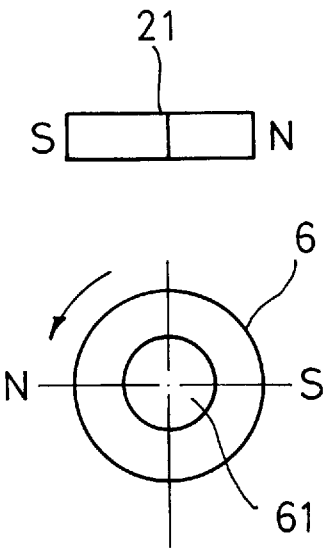
FIG. 11 is a schematic drawing showing the movement of the cylindrical magnet relative to the magnet of the floating ornament according to the present invention.

FIGS. 10 and 10A show a motion liquid display toy according to a sixth embodiment of the present invention with the exception of the locating ring 7. As illustrated, the locating ring 7 is mounted in the base 3 and stopped above the dial 41. The output shaft 42 of the transmission mechanism 4 protruding over the center hole 71 of the locating ring 7. The spherical magnet 8 is revolvably mounted in between the projecting rods 55 of the link 5 and disposed in contact with the inward annular flange 72 of the locating ring 7. When the transmission mechanism 4 is started to move the link 5, the spherical magnet 8 is moved by the link 5 along the inside annular flange 72 to act with the magnet 21 of the floating ornament 2, thereby causing the floating ornament 2 to move forwards or backwards in the surface of the liquid 11, to sink or float in the liquid 11, or to turn round.

The distance between the projecting rods 55 of the link 5 of the fifth or sixth embodiment of the present invention may be longer than the diameter of the spherical magnet 8, so that the spherical magnet 8 turns round and round between the projecting rods 55 when it is moved by the link 5 over the dial 41.

While only few embodiments of the present invention have been shown and described, it will be understood that various modifications and changes could be made without departing from the spirit and scope of the invention, for example, the cylindrical magnet 6 may be used in the fifth embodiment or sixth embodiment to replace the spherical magnet 8; a plurality of ornamental floats may be put in the liquid 11 and connected to the floating ornaments 2 by wires. In case the movement of a clock is used as the transmission mechanism, the connector of the link is preferably coupled to the shaft of the second's hand; two liquids of different specific gravity may be contained in the transparent container 1.

What the invention claimed is:

1. A motion liquid display toy comprising a base;

a transparent container mounted on said base and holding a liquid;

a floating ornament floating in said liquid and having a magnet at a bottom side; and a transmission mechanism mounted in said base and controlled to force said floating ornament to move in said liquid, wherein said transmission mechanism comprises a dial horizontally disposed in said base below said transparent container and having a center hole;

an output shaft extending vertically from the center hole of said dial;

a link suspended above said dial and extending in a horizontal plane parallel to a principal plane of said dial, said link having a first end coupled to said output shaft so as to be rotatable in said horizontal plane about a vertical axis of said output shaft, and a second end connected to a coupling device; and a magnetic member having at least two magnetic poles of opposite polarity coupled to the coupling device of said link, said magnetic member establishing a magnetic coupling with the magnet at the bottom of said ornament, wherein said coupling device is arranged to permit said magnetic member to move with respect to said link as said link rotates about said shaft, said movement of the magnetic member with respect to said link being different from said rotation of said link about said shaft such that said magnetic member carries out a compound motion made up of a first motion in the direction in which the link rotates about the shaft and a second motion which is different from the first motion, thereby causing a relative position between said ornament and respective said magnetic poles to change as the link rotates, in turn causing a polarity and strength of the magnetic coupling to vary and thereby cause said floating ornament to move forwards and backwards in said liquid, to sink or float in said liquid, and to turn round.

2. The motion liquid display toy of claim 1, wherein the magnetic member of said transmission mechanism is a cylindrical magnet.

3. The motion liquid display toy of claim 1, wherein the magnetic member of said transmission mechanism is a spherical magnet.

4. The motion liquid display toy of claim 1, wherein the magnetic member of said transmission mechanism is a disk having two magnetic bars reversely disposed at two opposite sides.

5. The motion liquid display toy of claim 1, further comprising a locating ring mounted in said base around said output shaft and said link, and above said dial, said locating ring having an inwardly extending annular flange adapted for supporting the movement of the magnetic member of said transmission mechanism.

6. The motion liquid display toy of claim 1, wherein the coupling device of said link is a coupling rod inserted through a hole in the magnetic member of said transmission mechanism; and wherein the magnetic member of said transmission mechanism is rotated about the coupling rod of said link, said magnetic member having a through hole which receives the coupling rod of said link.

7. The motion liquid display toy of claim 1, wherein the coupling device of said link comprises two downwardly projecting strips, and a pivot pin connected between said downwardly projecting strips, and wherein the magnetic member of said transmission mechanism is rotatable about the pivot pin of the coupling device of said link, said magnetic member having a pivot hole which receives the pivot pin of the coupling device of said link.

8. The motion liquid display toy of claim 1, wherein the coupling device of said link comprises two downwardly projecting strips, and a pivot pin connected between said downwardly projecting strips, and wherein the magnetic member of said transmission mechanism is a disk member rotatable about the pivot pin of the coupling device of said link, said magnetic member having two magnetic bars reversely disposed at two opposite sides.

9. The motion liquid display toy of claim 1, wherein the coupling device of said link comprises two parallel projecting rods longitudinally extending from the second end of said link, and wherein the magnetic member of said transmission mechanism is a spherical magnet movable between the projecting rods of said link over said dial.

10. The motion liquid display toy of claim 9, wherein a distance between the two parallel projecting rods of said coupling device is longer than a diameter of said spherical magnet.

11. The motion liquid display toy of claim 1, wherein the coupling device of said link comprises two parallel projecting rods longitudinally extending from the second end of said link, and wherein the magnetic member of said transmission mechanism is a cylindrical magnet movable between the projecting rods of said link over said dial.

12. The motion liquid display toy of claim 11, wherein a distance between the two parallel projecting rods of said coupling device is longer than a diameter of said cylindrical magnet.

13. The motion liquid display toy of claim 9, wherein the projecting rods of said link have a height not shorter than a radius of said spherical magnet.

14. The motion liquid display toy of claim 11, wherein the projecting rods of said link have a height not shorter than a radius of said cylindrical magnet.

15. The motion liquid display toy of claim 1, wherein said transmission mechanism is a movement of a clock.

16. The motion liquid display toy of claim 1, wherein said transmission mechanism is a clockwork of a musical box.

17. The motion liquid display toy of claim 1, further comprising a plurality of ornamental floats arranged to float in said liquid and connected to said floating ornament.

* * * * *